US009084318B2

(12) United States Patent
Yao et al.

(10) Patent No.: US 9,084,318 B2
(45) Date of Patent: Jul. 14, 2015

(54) PRIMARY-SIDE CONTROLLED SWITCH-MODE POWER SUPPLY CONTROLLER FOR DRIVING LED WITH CONSTANT CURRENT AND METHOD THEREOF

(75) Inventors: Yunlong Yao, Hangzhou (CN); Jianxing Wu, Hangzhou (CN)

(73) Assignee: HANGZHOU SILAN MICROELECTRONICS CO., LTD., Hangzhou, Zhejiang Province (CN)

( * ) Notice: Subject to any disclaimer, the term of this patent is extended or adjusted under 35 U.S.C. 154(b) by 271 days.

(21) Appl. No.: 13/607,244

(22) Filed: Sep. 7, 2012

(65) Prior Publication Data

US 2013/0057173 A1 Mar. 7, 2013

Related U.S. Application Data

(63) Continuation of application No. PCT/CN2012/070750, filed on Jan. 30, 2012.

(30) Foreign Application Priority Data

Feb. 1, 2011 (CN) ..... 2011 1 0034538

(51) Int. Cl.
*H05B 37/00* (2006.01)
*H05B 33/08* (2006.01)

(52) U.S. Cl.
CPC ..... *H05B 33/0815* (2013.01)

(58) Field of Classification Search
USPC ..... 315/206, 209 R, 210–213, 224, 225, 315/247, 276–279, 291, 307, 308, 312, 360
See application file for complete search history.

(56) References Cited

U.S. PATENT DOCUMENTS 6,963,496 B2 * 11/2005 Bimbaud ..... 363/21.16
7,239,532 B1 * 7/2007 Hsu et al. ..... 363/21.12
8,477,516 B2 * 7/2013 Chien et al. ..... 363/21.16

FOREIGN PATENT DOCUMENTS

CN 101772246 A 7/2010
CN 101925236 A 12/2010
JP 2007-142057 A 6/2007
WO WO 2010/015999 A1 2/2010

* cited by examiner

*Primary Examiner* — Douglas W Owens
*Assistant Examiner* — James H Cho
(74) *Attorney, Agent, or Firm* — Birch, Stewart, Kolasch & Birch, LLP

(57) ABSTRACT

The present invention discloses a primary-side controlled switch-mode power supply controller for driving LED with constant current and method thereof as well as an apparatus for controlling switch-mode power supply having the switch-mode power supply controller. The switch-mode power supply controller includes an input dimming phase detection circuit, a multiplier, a turn-on signal control circuit, a zero-crossing detection circuit, a comparator, a trigger and a driving circuit. The circuit controls to drive LED with constant current by means of a primary-side controlled method. The circuit realizes the triac dimming function, ensures a constant output current regardless of a high voltage or a low voltage, and obtains a high power factor. The direct use of the isolation transformer improves the safety of the circuit, and simplifies the peripheral circuit, thereby reducing the cost of the circuit and minimizing the size of the PCB layout, which is favorable in minimizing the product.

28 Claims, 5 Drawing Sheets

--Prior Art--

PRIMARY-SIDE CONTROLLED SWITCH-MODE POWER SUPPLY CONTROLLER FOR DRIVING LED WITH CONSTANT CURRENT AND METHOD THEREOF

CROSS REFERENCE TO RELATED APPLICATIONS

This application is a Continuation of PCT International Application No. PCT/CN2012/070750 filed on Jan. 30, 2012, which claims priority under 35 U.S.C 119(a) to Application No. 201110034538.0 filed in China on Feb. 1, 2011, all of which are hereby expressly incorporated by reference into the present application.

FIELD OF THE INVENTION

The present invention relates to LED lighting technology, and more specifically to power factor correction (PFC), triac dimming technology and primary-side controlled constant-current LED driver technology.

BACKGROUND

With the development of LED technology, the LED brightness and efficiency continues to improve. The continued development of LED lighting technology in daily life is becoming the mainstream in terms of energy saving and emission reduction and green lighting.

A traditional constant-current LED driver circuit with power factor correction (PFC) function powered by an alternating current can be categorized into two types, namely, isolating type and non-isolating type. The isolating type is further categorized into two types of control structure. One is a two-stage control structure and the other is a single-stage control structure. In comparison with the two-stage control structure, the circuit of the single-stage control structure is relatively simple and cost-saving.

In the isolating type LED driver circuit with single-stage control, a constant-current control signal is generally obtained by optical coupler feedback. The use of optical coupler feedback requires an additional error amplifier at the secondary side. The sampling of the output current also requires the optical coupler for isolation so as to deliver the output current to primary side. Thus, such a circuit requires relatively more components and entails a more complex implementation, resulting in a large size of PCB layout, which is unfavorable to the minimization of the products and may lead to a high cost.

SUMMARY

The purpose of the present invention is to overcome the deficiency of the prior art. The present invention proposes a primary-side controlled switch-mode power supply controller for driving LED with constant current and method thereof. The controller integrates the functions of power factor correction, triac dimming and primary-side controlled constant-current LED driver. Meanwhile, the present invention provides an apparatus using the foregoing controller for constituting a single-stage LED switch-mode power supply.

A primary-side controlled switch-mode power supply controller for driving LED with constant current is provided. The controller includes:

a multiplier circuit, configured to receive a signal indicative of an instantaneous input AC voltage, and output a reference voltage signal, wherein the reference voltage signal is in direct proportion with the instantaneous input AC voltage;

a zero-crossing detection circuit, configured to receive an auxiliary winding signal, detect a conduct time of a freewheeling diode at a secondary side, and output a zero-crossing detection signal;

a turn-on signal control circuit, configured to receive the zero-crossing detection signal output by the zero-crossing detection circuit and the reference voltage signal output by the multiplier circuit, control a ratio of the conduct time of the freewheeling diode at the secondary side of the switch-mode power supply to a switching cycle of a power switch of the switch-mode power supply such that the ratio is in direct proportion to the reference voltage signal output by the multiplier circuit, calculate the switching cycle of the power switch so as to control the moment when the power switch starts to turn on, and output a turn-on signal for the power switch;

a comparator circuit, configured to sample a peak current at the primary side of a transformer of the switch-mode power supply and compare the peak current with the reference voltage signal, wherein when a voltage sampled from the peak current at the primary side equals the reference voltage signal output by the multiplier circuit, the comparator circuit is configured to output a turn-off signal for the power switch;

a trigger circuit, configured to receive a signal output from the turn-on signal control circuit and a signal output from the comparator, and output a first driving signal to a driving circuit;

the driving circuit, configured to receive the first driving signal from the trigger circuit, wherein when the output from the comparator is the turn-off signal for the power switch, the driving circuit controls to turn off the power switch; when the output from the turn-on signal control circuit is the turn-on signal for the power switch, the driving circuit controls to turn on the power switch.

The controller further includes a dimming phase detection circuit, configured to detect a triac dimming phase of the input AC voltage, and convert the triac dimming phase signal to a DC voltage signal and feed the DC voltage signal to an input terminal of the multiplier in which the DC voltage signal multiplies with the instantaneous input AC voltage, in order to realize dimming effect.

Further, the dimming phase detection circuit includes a dimming comparator circuit and a low-pass filter. The dimming comparator circuit is configured to compare an input triac dimming signal with a predetermined reference voltage which is near zero, and convert the input dimming signal to a duty cycle signal that varies with a dimming phase. The low-pass filter is configured to filter the duty cycle signal to a DC voltage signal which is the dimming phase signal. The dimming phase signal is fed to the input terminal of the multiplier circuit in which the DC voltage signal multiplies with the instantaneous input AC voltage.

The turn-on signal control circuit may be implemented with a circuit for charging and discharging a capacitor with a current, wherein the current for charging and discharging the capacitor refers to the following: a charging current for charging the capacitor within the conduct time of the freewheeling diode at the secondary side of the switch-mode power supply; a discharging current for discharging the capacitor within a non-conduct time of the freewheeling diode at the secondary side, wherein by balancing the charging charges and the discharging charges, the ratio of the conduct time of the freewheeling diode at the secondary side of the switch-mode power supply to the switching cycle is controlled so that the ratio is in direct proportion to the reference voltage output by the multiplier circuit.

The turn-on signal control circuit may also be a first timer circuit configured to control the ratio of the conduct time of the freewheeling diode at the secondary side to the switching cycle such that the ratio is in direct proportion to the reference voltage signal output by the multiplier circuit.

In order to endow the switch-mode power supply with a constant-current feature in the case where the input AC voltage of the switch-mode power supply varies, the controller further includes a circuit for detecting an effective input AC voltage or an average input AC voltage, configured to detect and obtain the effective input AC voltage or the average input AC voltage, which is then fed into an input terminal of the multiplier circuit in which the instantaneous input AC voltage is divided by the effective input AC voltage or the average input AC voltage and an AC input detection signal irrelevant with the effective input AC voltage or the average input AC voltage is obtained, the AC input detection signal is a normalized instantaneous AC input which replaces the instantaneous input AC voltage.

The circuit for detecting effective input AC voltage or average input AC voltage is implemented with a low-pass filter.

The comparator circuit is replaced with a second timer circuit, and the conduct time of the power switch is controlled by the second timer circuit, wherein when the conduct time of the power switch reaches a fixed conduct time set by the second timer circuit, the second timer circuit outputs a turn-off signal for the power switch. When there is a need to output a constant current regardless of a high voltage or a low voltage, the fixed conduct time is in inverse proportion with the effective input AC voltage or the average input AC voltage. When there is need to realize the triac dimming function, the fixed conduct time is in direct proportion with the dimming phase signal. A method for controlling a primary-side controlled switch-mode power supply for driving LED with constant current is provided. The method includes the following steps.

Step 1: sampling an instantaneous input AC voltage and then outputting to an input terminal of a multiplier;

Step 2: outputting, by the multiplier, a reference voltage signal which is in direct proportion to the instantaneous input AC voltage;

Step 3: turning off a power switch of the switch-mode power supply when a peak current at a primary side of a transformer reaches the reference voltage signal;

Step 4: detecting a voltage across an auxiliary winding of the switch-mode power supply and obtaining a conduct time of a freewheeling diode at a secondary side of the switch-mode power supply;

Step 5: setting a ratio of the conduct time of the freewheeling diode at the secondary side to a switching cycle of the power switch such that the ratio is in direct proportion to the reference voltage signal output by the multiplier, calculating the switching cycle of the power switch so as to control the moment when the power switch starts to turn on, and outputting the turn-on signal for the power switch.

Step 1 through step 5 ensures a constant output current, while still realizes the power factor correction function.

Further, in order to ensure the switch-mode power supply with a constant current in the case where the input AC voltage of the switch-mode power supply varies, step 1 further includes detecting an effective input AC voltage or average input AC voltage, obtaining the effective input AC voltage or the average input AC voltage, feeding into an input terminal of the multiplier; dividing, in the multiplier, the input AC voltage by the effective input AC voltage or the average input AC voltage, obtaining an AC input detection signal irrelevant with the effective input AC voltage or the average input AC voltage, wherein the AC input detection signal is a normalized instantaneous AC input which serves as the reference voltage signal.

In addition, step 1 further includes detecting a triac dimming phase of the instantaneous input AC voltage, and converting a dimming phase signal to a DC voltage signal to feed to an input terminal of the multiplier in which the DC voltage signal multiplies with the instantaneous input AC voltage, in order to realize dimming effect. A further implementation includes comparing a the triac dimming phase signal with a predetermined reference voltage which is near zero, and converting the input dimming signal to a duty cycle signal that varies with a dimming phase; filtering the duty cycle signal to a DV voltage signal, i.e., a dimming phase signal; inputting the dimming phase signal to an input terminal of the multiplier; and multiplying with the instantaneous input AC voltage.

A primary-side controlled switch-mode power supply apparatus for driving LED, comprising an AC input rectification circuit (101), an output rectification circuit (D1), a switch-mode power supply controller (201) for inputting a sampled input AC voltage Vac, a sampling resistor Rs for sampling a primary current of an isolation transformer (105), a power switch (106), the isolation transformer (105) for transferring an input energy to an output, characterized in that, the switch-mode power supply controller (201) includes the foregoing primary-side controlled switch-mode power supply controller for driving LED with constant current.

For the above controller and the above method, the conduct time of the switch adopts a peak current control mode or a fixed conduct time mode. In the case of the peak current control mode, the peak current determines the conduct time of the switch. The peak current through the inductor is directly proportional to the instantaneous input AC voltage and is inversely proportional to the effective input AC voltage or the average input AC voltage. The switching cycle is realized by the turn-on signal control circuit. The turn-on signal control signal ensures that the ratio of the freewheeling time of the diode at the secondary side to the switching cycle is constant. Thus, both the constant-current control and the PFC functions can be achieved. In the case of a fixed conduct time mode, both the constant-current control and the PFC functions can be also be achieved.

The present invention enjoys the below benefits. The circuit controls to drive LED with a constant current by means of a primary-side controlled method. The circuit realizes the triac dimming function, ensures a constant output current regardless of a high input AC voltage or a low input AC voltage, and achieves a high power factor. Further, optical coupler feedback as well as an error amplifier at the secondary side is omitted in the circuit. The direct use of the transformer for isolation purpose improves the safety of the circuit, and simplifies the peripheral circuit, thereby reducing the cost of the circuit and minimizing the size of the PCB layout, which is favorable in minimizing the size of the product.

DETAILED DESCRIPTION

Illustrations are made to the present disclosure in connection with the accompanying drawings.

Figure 1:
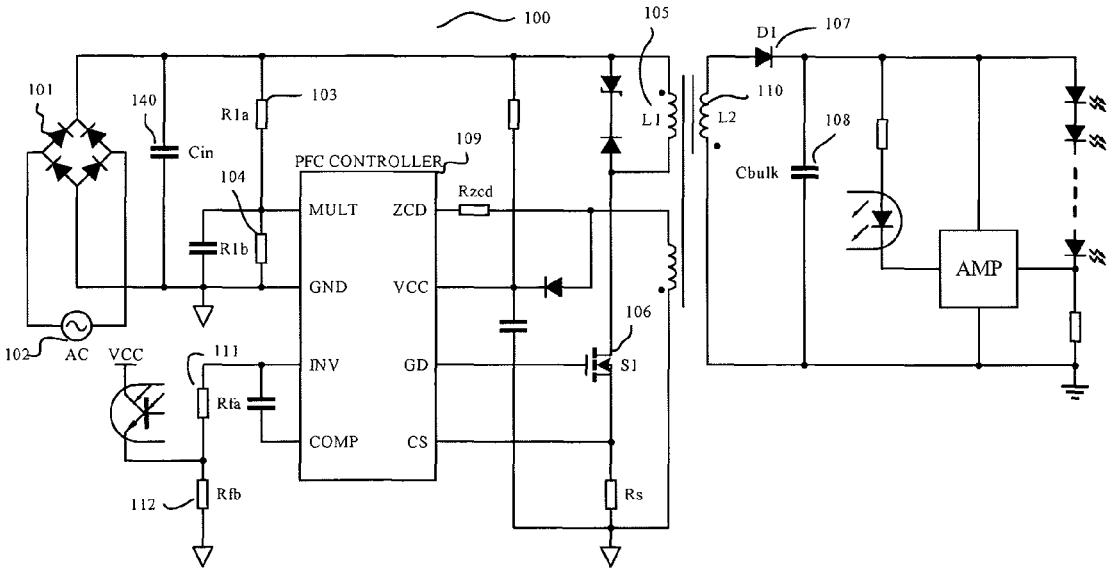
FIG. 1 illustrates a schematic of a conventional single-stage switch-mode power supply for driving LED.

FIG. 1 illustrates a schematic of a conventional single-stage switch-mode power supply for driving LED. The single-stage switch-mode power supply for driving LED includes an AC input rectification circuit 101, an output rectification circuit D1, a PFC controller 109, a power switch 106, etc. The input energy is transferred to the output via an isolation transformer 105.

The circuit samples the output current at a secondary side. An amplifier 120 is used to amplify an error signal. The amplified error signal is then fed to the PFC controller 109 at a primary side via an optical coupler. Constant current and PFC function are achieved by controlling the power switch 106. Since a conventional PFC (power factor correction) controller is specialized in boost mode control, it may hinder the circuit to achieve an ideal PFC performance. Specially, in the case of a high voltage input, the power factor will decrease. Since the circuit samples the current at the secondary side, the circuit cannot be simplified significantly. As a result, the PCB layout area can also be large, which is not favorable to the minimization of the size of the products.

Figure 2:
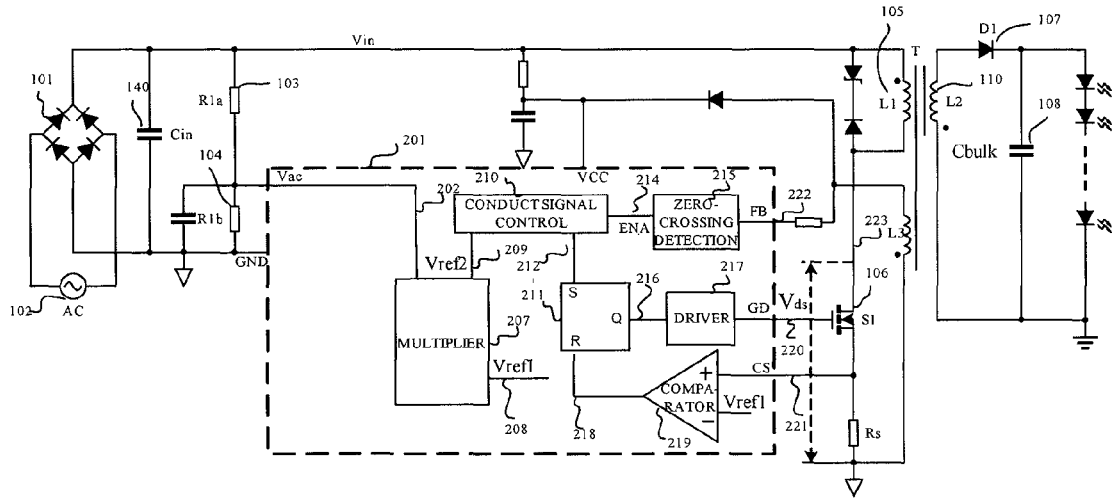
FIG. 2 illustrates a primary-side controlled switch-mode power supply for driving LED with constant current according to a first embodiment of the present invention.
Figure 3A:
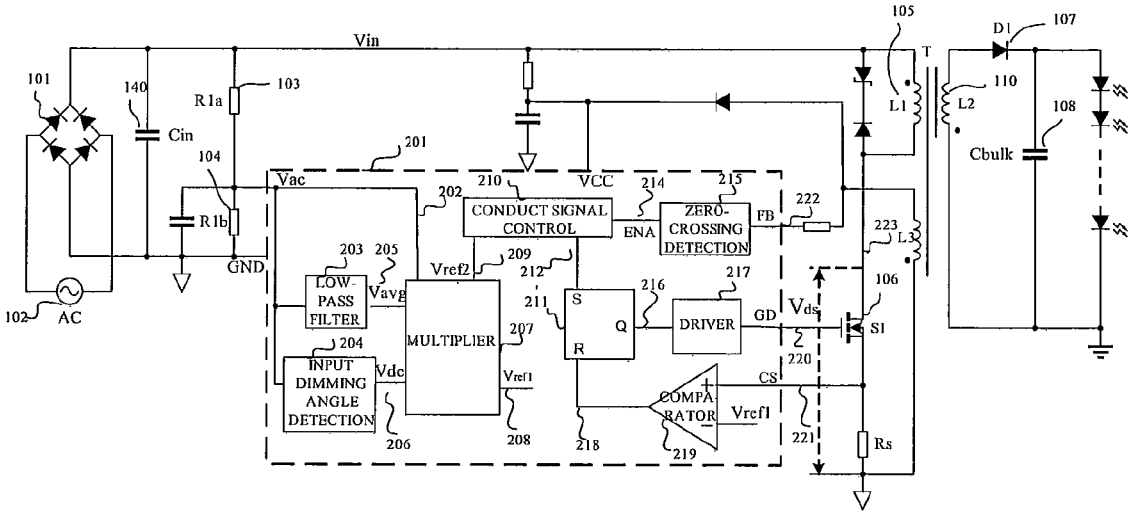
FIG. 3A illustrates a primary-side controlled switch-mode power supply for driving LED with constant current according to a second embodiment of the present invention.

FIG. 2 illustrates a primary-side controlled switch-mode power supply for driving LED with constant current according to a first embodiment of the present invention. FIG. 3A illustrates a primary-side controlled switch-mode power supply for driving LED with constant current according to a second embodiment of the present invention. Compared with FIG. 2, two modules are added in FIG. 3A, i.e., an input dimming phase detection circuit 204 and a low-pass filter 203. The input dimming phase detection circuit 204 is used to implement the triac dimming function. The low-pass filter 203 is used to ensure a same constant current value regardless of a high input AC voltage or a low input AC voltage.

As shown in FIG. 3A, the primary-side controlled switch-mode power supply for driving LED with constant current includes an AC input rectification circuit 101, an output rectification circuit D1, a switch-mode power supply controller 201 for inputting a sampled input AC voltage Vac, a sampling resistor Rs for sampling the current at a primary side of the isolation transformer 105, and a power switch 106. The input energy is transferred to the output via the isolation transformer 105. The switch-mode power supply controller 201 may include a multiplier 207, a zero-crossing detection circuit 215, a turn-on signal control circuit 210, a comparator 219, a trigger 211, a driving circuit 217, and a dimming phase detection circuit 204.

The multiplier 207 is configured to receive a signal indicative of an instantaneous input AC voltage, such as the sampled instantaneous AC voltage signal Vac of the switch-mode power supply obtained after rectification, an effective signal Vavg205 of the input AC voltage and a DC voltage signal Vdc206 indicative of the dimming phase. The multiplier 207 outputs a second reference voltage Vref2 209 to the turn-on signal control circuit 210 and outputs a first reference voltage Vref1 208 to the comparator 219, wherein the second reference voltage Vref2 is proportional to the first reference voltage Vref1. The second reference voltage Vref2 and the first reference voltage Vref1 are directly proportional to the instantaneous input AC voltage.

The zero-crossing detection circuit 215 is configured to receive an auxiliary winding signal 222 of the switch-mode power supply according to the feedback terminal FB, and generate a signal ENA indicative of a conduct time TOFF1 of the freewheeling diode at the secondary side of the switch-mode power supply. That is, the zero-crossing detection signal ENA is fed to the turn-on signal control circuit 210.

The turn-on signal control circuit 210 is configured to receive the zero-crossing detection signal ENA output by the zero-crossing detection circuit 215 and the second reference voltage signal 209 output by the multiplier 207, control a ratio of the conduct time of the freewheeling diode at the secondary side of the switch-mode power supply to the switching cycle of the power switch of the switch-mode power supply such that the ratio is in direct proportion to the reference voltage output by the multiplier 207, calculate the switching cycle of the power switch so as to control the moment when the power switch starts to turn on, and output the turn-on signal 212 of the power switch.

The comparator 219 is configured to compare the first reference voltage signal from the multiplier 207 with a signal cs221 across the sampling resistor Rs and send a signal 218 indicating the result of comparator to the trigger 211.

The trigger 211 is configured to generate a trigger signal 216 to a driving circuit 217 according to the signal 212 from the trigger 211 and the signal 218 from the comparator 219.

The driving circuit 217 is configured to receive the trigger signal 216 from the trigger 211 and output a voltage signal Vds 220 to the power switch S1 106 of the switch-mode power supply.

The input dimming phase detection circuit 204 is configured to generate a DC voltage signal Vdc206 indicating the triac dimming phase according to the sampled input AC voltage Vac and feed the DC voltage signal Vdc206 to the multiplier 207. The lower the DC voltage signal Vdc206, the wider the triac dimming phase. When the dimming function is not used, the input dimming phase detection circuit 204 is not enabled.

Figure 4A:
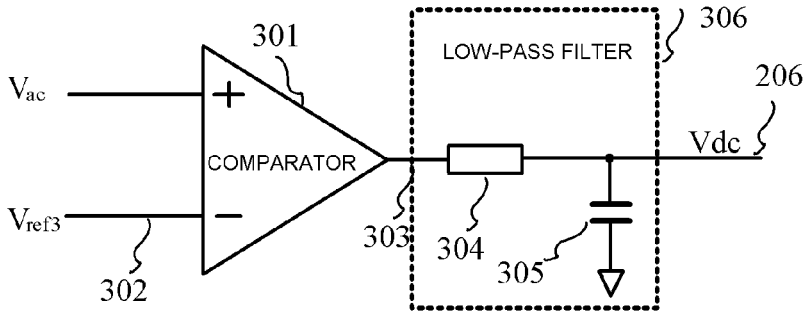
FIG. 4A illustrates a schematic of an input dimming phase detection circuit according to the present invention.
Figure 4B:
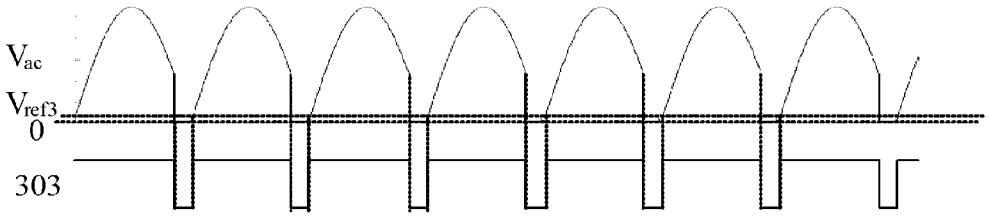
FIG. 4B illustrates a diagram showing the timing relation among the control signals in FIG. 4A.

FIG. 4A illustrates a schematic of an input dimming phase detection circuit 204 according to the present invention. The circuit includes a comparator 301 and a low-pass filter 306. The input signal Vac is a input triac dimming signal. The voltage Vref3 302 is a given near-zero reference voltage, which is used to detect the triac dimming phase. By virtue of the dimming comparator 301, the input triac dimming signal is converted into a duty cycle signal which varies with the triac dimming phase. This duty cycle signal is then filtered by a low-pass filter into a DC voltage signal Vdc206. The high or low value of the DC voltage indicates the level of the triac dimming phase. The higher the DC voltage, the smaller the triac dimming phase. When the DC is at the highest level, no dimming is performed. If the output of the dimming comparator 301 is inversed, then the smaller the triac dimming phase the higher the DC voltage. When no dimming is performed, the output voltage is near zero. Thus, a DC signal indicating the triac dimming phase can also be obtained.

The circuit for detecting an effective input AC voltage or an average input AC voltage is implemented by the low-pass filter 203. The low-pass filter 203 is configured to generate an effective signal Vavg205 of the sampled input AC voltage Vac, which is then fed into the multiplier 207.

Further description is as follows.

The multiplier 207 is used to realize a normalized function of the input AC voltage. The multiplier module receives a signal indicative of a sampled instantaneous AC voltage Vac of the switch-mode power supply whose input AC voltage has been rectified, an effective signal Vavg205 of the input AC voltage and a DC voltage signal Vdc206 indicative of the triac dimming phase and calculate the two reference voltages.

$$V_{ref1} = \frac{K_1 \cdot V_{ac} \cdot V_{dc}}{V_{avg}} \tag{1}$$

$$V_{ref2} = \frac{K_2 \cdot V_{ac} \cdot V_{dc}}{V_{avg}} \tag{2}$$

wherein K1, K2 are scale factors determined by the circuit structure of the multiplier.

First, a situation where no dimming is performed is discussed.

Assume the rectified input AC voltage is given below:

$$V_{in}=V_M \cdot |\sin \omega t| \tag{3}$$

wherein $V_M$ denotes the amplitude of the input AC voltage, ω denotes the angular frequency of the input AC voltage, and t demotes the time.

Then, the instantaneous sampled AC voltage Vac which has been rectified is directly proportional to $V_M$. The effective input AC voltage Vavg is also directly proportional to $V_M$. At this moment, Vdc is a constant. Accordingly, Vref1 and Vref2 are irrelative to the amplitude of the input AC voltage. Vref1 and Vref2 are only associated with the phase of the input AC voltage, which is a normalized function.

That is, Vref1 and Vref2 can be expressed as follows:

$$V_{ref1}=K_3 \cdot |\sin \omega t| \tag{4}$$

$$V_{ref2}=K_4 \cdot |\sin \omega t| \tag{5}$$

where K3 and K4 are scale factors.

The conduct of the power switch is controlled by the comparator 219. During the period when the power switch S1 turns on, the inductor current through the inductor L1 continues to increase. When the current reaches to a current limit which is set by a comparison point of the comparator, i.e., the current reaches a reference voltage signal, the output of the comparator 219 inverts. By virtue of the following trigger 211 and the driving circuit 217, the power switch S1 turns off. If the current value at the moment that the power switch turns on is zero and assume the conduct time is Ton, the primary inductance is L, the current peak at the moment that the power switch turns off is $I_{pk}$, the input AC voltage is $V_{in}$, the voltage drop across the rectifier and the power switch is $V_{drop}$ (which is usually neglected).

Then the following relationship is obtained:

$$I_{pk} = \frac{V_{ref1}}{R_S} = \frac{K_3 \cdot |\sin \omega t|}{R_S} \tag{6}$$

$$T_{on} = \frac{L \cdot I_{pk}}{V_{in} - V_{drop}} \approx \frac{L \cdot I_{pk}}{V_{in}} = \frac{L \cdot I_{pk}}{V_M \cdot |\sin \omega t|} = \frac{L \cdot \frac{K_3 \cdot |\sin \omega t|}{R_S}}{V_M \cdot |\sin \omega t|} = \frac{L \cdot K_3}{V_M \cdot R_S} \tag{7}$$

That is, the conduct time is associated with the primary inductance L, parameter K3 which is set internally, a sampling resistor Rs, and the effective input AC voltage $V_M$. In the case of a given input AC voltage (the effective value is constant), if the parameters of the peripheral components of the switch-mode power switch is constant, the conduct time of the switch-mode power supply is fixed.

By properly designing the parameters of the peripheral components, the current of the switch-mode power switch is firstly ensured to be at a discontinuous mode. Assume that the output voltage of the switch-mode power supply is $V_{out}$, the voltage drop across the rectifier diode at the secondary side is $V_d$ (which is generally neglected), the turns ratio of the transformer (the ratio of the turns of the primary windings to turns of the secondary windings) is n. The moment the power switch turns off, the current of the transformer flies back. A peak current $I'_{pk}$ is generated through the secondary windings and the relation between the peak current of the secondary windings and the peak current $I_{pk}$ of the primary windings is formulated below:

$$I'_{pk}=n \cdot I_{pk}$$

Then, the time period that the current is kept outputting from the output windings is calculated as follows:

$$T_{OFF1} = \frac{L' \cdot I'_{pk}}{V_{out} + V_d} \approx \frac{L \cdot I_{pk}}{n \cdot V_{out}} \tag{8}$$

Assume a cycle of the power switch is T, the average input current during each cycle is formulated as follows:

$$I_{in}^{-} = \frac{1}{2} \cdot \frac{T_{on}}{T} \cdot I_{pk} \qquad I_{in}^{-} = \frac{1}{2} \cdot \frac{L \cdot K_3}{T \cdot V_M \cdot R_S} \cdot I_{pk} \tag{9}$$

The average output current during each cycle is calculated as follows:

$$I_{out}^{-} = \frac{1}{2} \cdot \frac{T_{OFF1}}{T} \cdot I'_{pk} \qquad I_{out}^{-} = \frac{1}{2} \cdot \frac{T_{OFF1}}{T} \cdot n \cdot I_{pk} \tag{10}$$

Figure 3B:
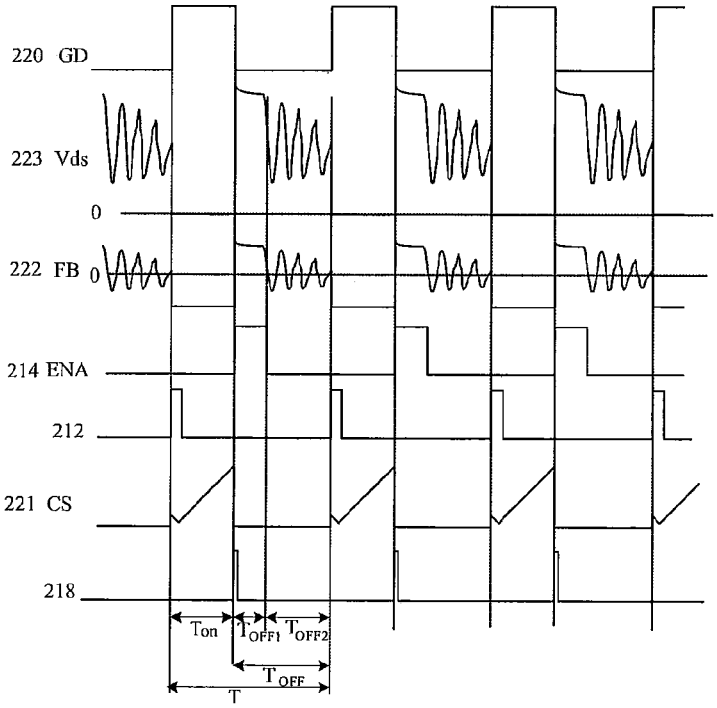
FIG. 3B illustrates a diagram showing the timing relation among the control signals in FIG. 2 and FIG. 3A.

FIG. 3B illustrates a diagram showing the timing relation among the control signals in FIG. 2 and FIG. 3A. The conduct time Ton is obtained by the comparator 219. The switching cycle is determined by the turn-on signal control circuit 210. The signal ENA indicating a freewheeling time TOFF1 of the rectifier diode at the secondary side is obtained by the feedback signal FB 222.

Below is an implementation of the turn-on signal control circuit 212. Let $$\frac{T_{OFF1}}{T} = K_5 \cdot V_{ref2} = K_4 \cdot K_5 \cdot |\sin\omega t| \tag{11}$$

The following formula is obtained based on formula (6), (8), (11):

$$T = \frac{L \cdot K_3}{K_4 \cdot K_5 \cdot n \cdot V_{out} \cdot R_S} \tag{12}$$

That is, the switching cycle is associated with the output voltage and is irrelevant with the input AC voltage.

Put formula (6), (12) into formula (9), and put formula (6), (11) into formula (10):

$$I_{\overline{in}} = \frac{1}{2} \cdot \frac{K_3 \cdot K_4 \cdot K_5 \cdot n \cdot V_{out}}{V_M \cdot R_S} \cdot |\sin\omega t| \tag{13}$$

$$I_{\overline{out}} = \frac{1}{2} \cdot \frac{n \cdot K_3 \cdot K_4 \cdot K_5}{R_S} \cdot |\sin\omega t|^2 \tag{14}$$

As can be seen from formula (13), the average input current is equal to the input AC voltage during each switching cycle, which may result in a better PFC value. As can be seen from formula (14), the average output current is irrelevant with the effective input AC voltage during each switching cycle, which also has nothing to do with the input AC voltage. In an input AC cycle, the total average output current, when the input wide voltage range varies, is kept constant. The average current in the case of different output voltages can also be kept constant. That is, a constant-current output is achieved.

Based on the above analysis, the turn-on signal control circuit 210 functions to determine a next time point to turn on the switch according to the conduct time TOFF1 of the freewheeling diode 107 at the secondary side. That is, the turn-on signal control circuit 210 predicts the switching period T according to the conduct time TOFF1 of the freewheeling diode 107 at the secondary side. After the circuit operates steadily, the insurance of the formula (11) allows the circuit to achieve PFC and constant current.

Below is a detailed implementation of the turn-on signal control circuit 212.

Figure 5:
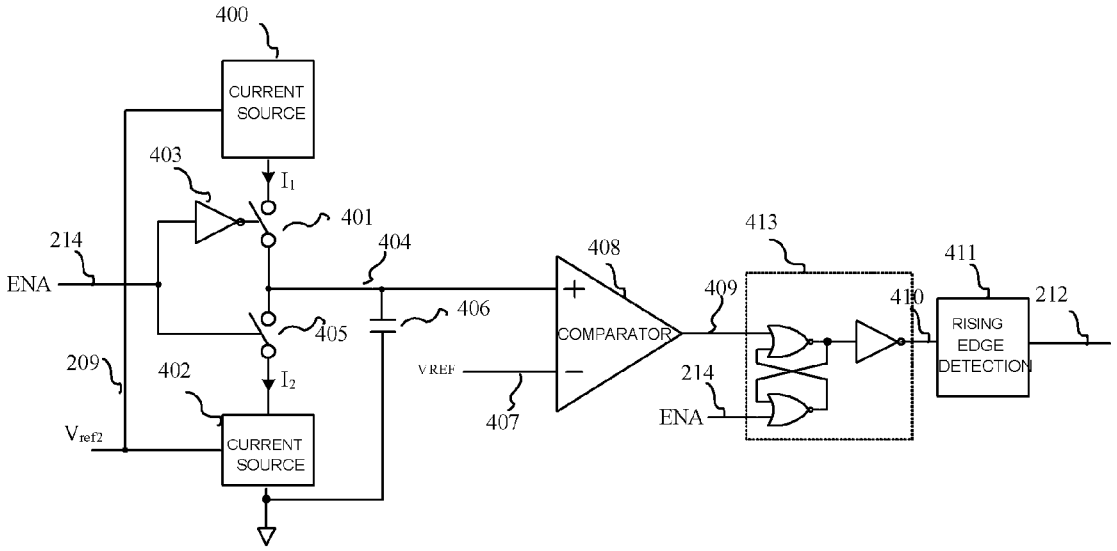
FIG. 5 illustrates a schematic of a turn-on signal control circuit according to the present invention.

FIG. 5 illustrates a diagram of the turn-on signal control circuit. The circuit may include a first controllable current source 400, a second controllable current source 402, a first switch 401, a second switch 405, a capacitor 406, a comparator 408, a trigger 413, and a rising edge detection circuit 411.

The first controllable current source 400 generates a first current I1. The second controllable current source 402 generates a second current I2. The first current I1 and the second current I2 are associated with the output voltage Vref2 209 of the multiplier 207. The ENA signal is a pulse signal associated with the conduct of the rectifier diode at the secondary side. When the ENA signal is high, the second switch 405 conducts, the first switch 401 turns off, and the capacitor 406 is discharged. When the ENA signal is low, the first switch 401 turns on, the second switch 405 turns off, and the capacitor 406 is charged. After the circuit operates in a steady mode, the charge and the discharge are balanced. An internal reference voltage VREF is set. When the voltage 404 is higher than the voltage VREF, the output voltage 409 of the comparator 408 is high. The voltage 410 is high by virtue of the trigger. When the voltage 404 is below the voltage VREF, the output voltage 409 of the comparator 408 is low and the level of the voltage 410 is determined by the signal ENA. Since the signal ENA is already in a high level before the voltage 409 turns to a low level, the voltage 410 is also low when the voltage 409 is low. The voltage 410 becomes an output pulse 212 through the rising edge detection module. The output pulse 212 is fed to the trigger 211. The following driving module 217 is configured to drive the power switch for controlling the turn-on of the power switch.

Figure 6:
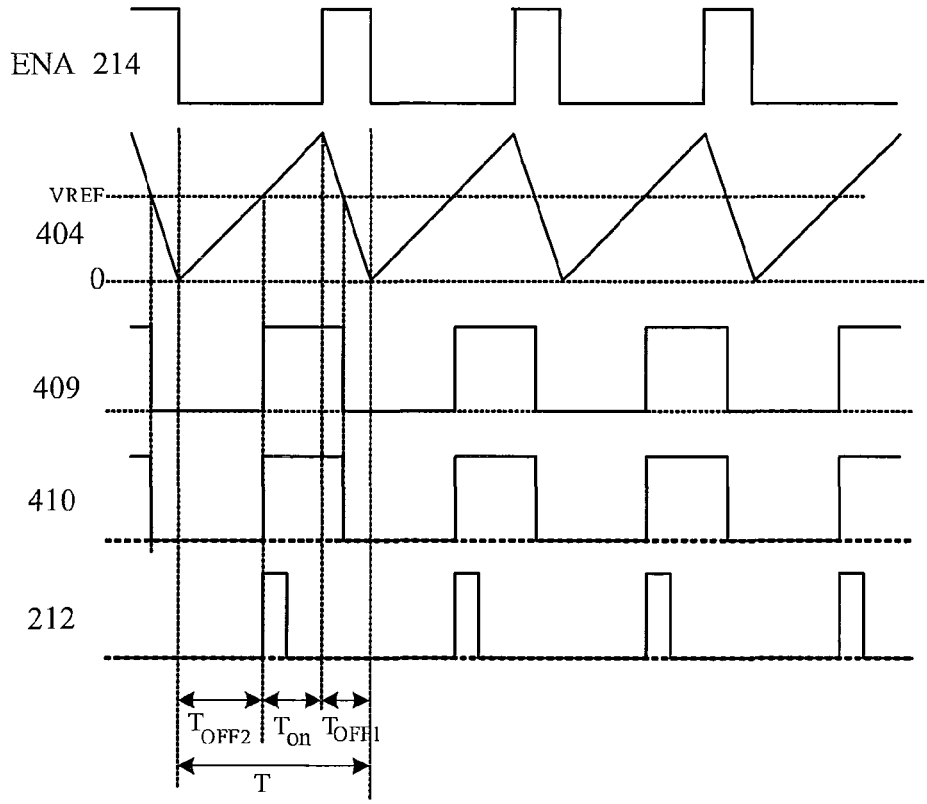
FIG. 6 illustrates a diagram showing the timing relation among the control signals in FIG. 5.

FIG. 6 illustrates a diagram showing the timing relation among the control signals in FIG. 5. After the circuit is in a steady mode, the number of the charged charges is equal to the number of the discharged charges. The following relation exists:

$$I_1 \cdot (T - T_{OFF1}) = I_2 \cdot T_{OFF1} \tag{15}$$

i.e.:

$$\frac{T_{OFF1}}{T} = \frac{I_1}{I_1 + I_2} \tag{16}$$

First, let $$I_1 = \frac{V_{ref3}}{R_1} \tag{17}$$

This can be realized easily by a circuit for converting a voltage to a current.

Then, let $$I_2 = I_0 - \frac{V_{ref3}}{R_1} \tag{18}$$

wherein R1 is an equivalent resistor when the voltage is transformed to the current. I0 is a reference current set internally. By setting the internal circuit, it is ensured that I2 is always kept greater than zero.

Then, the following equation can be obtained.

$$\frac{T_{OFF1}}{T} = \frac{V_{ref3}}{I_0 \cdot R_1} \tag{19}$$

Thus, the requirement of formula (11) is fulfilled. Accordingly, the PFC function and constant-current output are realized.

According to the foregoing description, the circuit can realize the PFC function and constant-current output. Moreover, the output constant-current is irrelevant with the effective input AC voltage. If the actual circuit only requires to realize a constant-current output within a very narrow range of the input AC voltage, the multiplier circuit may be omitted. The corresponding $V_{ref1}$ and $V_{ref2}$ have the same voltage as the input AC voltage and their amplitudes are associated with the input AC voltage. At this point, the detected voltage Vac, which is a direct AC input, may replace $V_{ref1}$ and $V_{ref2}$. The rest parts of the circuit remains the same. Such circuit can also realize a constant-current output and PFC function.

During dimming, the multiplier module 207 includes a dimming signal which allows $V^{ref1}$ and $V_{ref2}$ to vary with the dimming phase, as illustrated in formula (1) and (2). If a more visible dimming effect is desired, an adjusting method may be provided by changing the dimming signal in formula (1) or/and formula (2). Formula (1) or/and formula (2) is changed as follows:

$$V_{ref1} = \frac{K_1' \cdot V_{ac} \cdot V_{dc} \cdot V_{dc}}{V_{avg}} \tag{20}$$

$$V_{ref2} = \frac{K_2' \cdot V_{ac} \cdot V_{dc} \cdot V_{dc}}{V_{avg}} \tag{21}$$

At this point, there is no need to make change to the other parts of the circuit, while still achieving a more visible dimming effect.

According to formula (7), the turn-on time is a constant. In the case of a given usage of the circuit, the inductance L is constant and the turn-on time is controlled by the effective input AC voltage. Accordingly, it is possible to alter the associated circuit module which determines the conduct time of the power switch to a circuit for generating a fixed turn-on time. The turn-on time is determined by the signal Vavg205. The remaining parts of the circuit may be implemented in the same way as previously described. This circuit can achieve the PFC function, triac dimming, and constant-current output as well.

Figure 7:
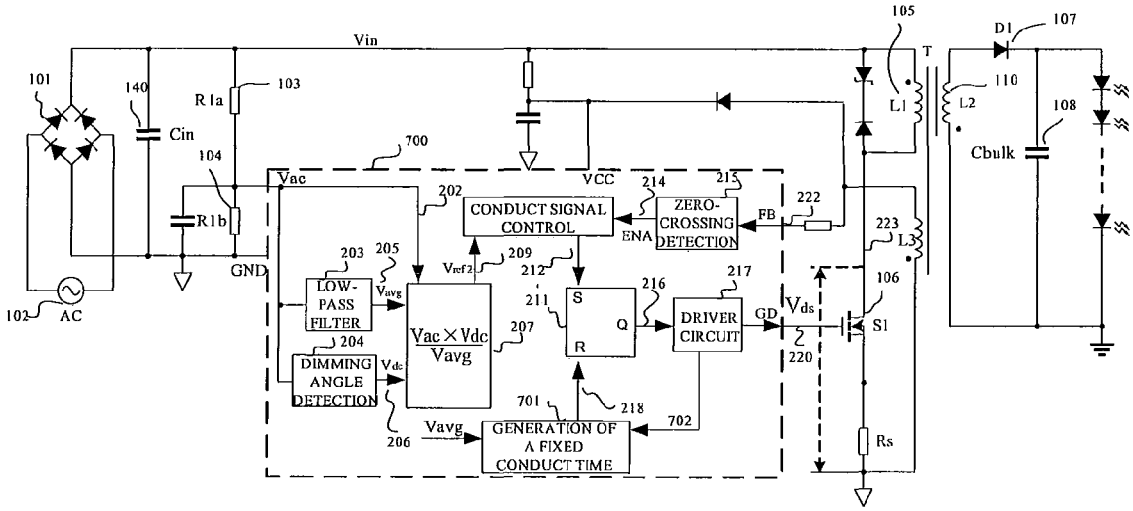
FIG. 7 illustrates a primary-side controlled switch-mode power supply for driving LED with constant current according to a third embodiment of the present invention.

FIG. 7 illustrates a single-stage switch-mode power supply for driving LED according to a second embodiment of the present invention. The embodiment as illustrated in FIG. 7 is essentially the same with FIG. 2, except that it is the circuit for generating a fixed turn-on time 701 that determines the turn-on time of the switch. The circuit for generating a fixed turn-on time 701 receives the effective value Vavg205 of the sampled input AC voltage Vac from the low-pass filter 203 and the voltage signal 702 from the driving circuit 217, and outputs the voltage signal 218 to the trigger 211. The voltage signal 218 is generated by the circuit for generating a fixed turn-on time 701 rather than the comparator 219.

Figure 8:
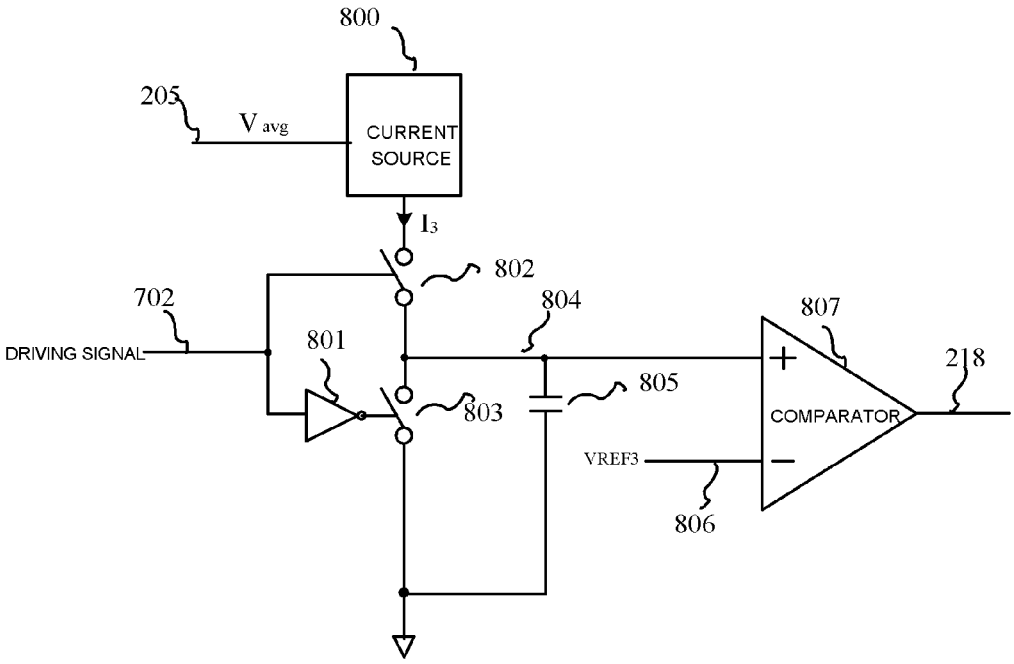
FIG. 8 illustrates a schematic of a fixed turn-on signal control circuit according to the present invention.

FIG. 8 illustrates a schematic of a fixed turn-on signal control circuit according to the present invention. That is, FIG. 8 is an embodiment of the circuit for generating the fixed turn-on time. When there is a driving signal output from the circuit, the voltage 702 is at a high level. At this point, the capacitor 805 is charged. The third charging current I3 is determined by the average Vavg of the input AC voltage. The third current I3 is in direct proportion to the average Vavg of the input AC voltage. When the charges on the capacitor 805 accumulates to reach a certain voltage VREF3 (VREF3 is a reference voltage, which is generated internally), the comparator 807 inverts and the output voltage 2108 turns to a high level. RS trigger is configured to cut off the output. When the driving signal is cut off, the driving signal 702 is at a low voltage level and the capacitor 805 is pulled down to a zero voltage. The output voltage 218 of the comparator 807 is zero.

The present invention discloses a primary-side controlled switch-mode power supply controller for driving LED with constant current and method thereof, which has the PFC function and triac dimming function. Detailed description and effects are described in conjunction with the drawings. It is appreciated that the foregoing embodiments are only illustrative. The present invention is not intended to be limiting in these respects. Any modification conceived without departing from the scope of the present invention, including a partial modification to the multiplier, the conduct signal control circuit and the timing of the control signals, a change to parts of the circuit, a replacement of the type or model of any component as well as other non-substantial replacement or variation, shall be construed as falling within the scope of the present invention.

What is claimed is:

1. A primary-side controlled switch-mode power supply controller for driving LED with constant current, comprising:

a multiplier circuit, configured to receive a signal indicative of an instantaneous input AC voltage, and output a reference voltage signal, wherein the reference voltage signal is in direct proportion with the instantaneous input AC voltage;

a zero-crossing detection circuit, configured to receive an auxiliary winding signal, detect a conduct time of a freewheeling diode at a secondary side, and output a zero-crossing detection signal;

a turn-on signal control circuit, configured to receive the zero-crossing detection signal output by the zero-crossing detection circuit and the reference voltage signal output by the multiplier circuit, control a ratio of the conduct time of the freewheeling diode at the secondary side to a switching cycle of a power switch such that the ratio is in direct proportion to the reference voltage signal output by the multiplier circuit, calculate the switching cycle of the power switch so as to control the moment when the power switch starts to turn on, and output a turn-on signal for the power switch;

a comparator circuit, configured to sample a peak current at the primary side of a transformer of the switch-mode power supply and compare the peak current with the reference voltage signal, wherein when a voltage sampled from the peak current at the primary side equals the reference voltage signal output by the multiplier circuit, the comparator circuit is configured to output a turn-off signal for the power switch; and a trigger circuit, configured to receive an output control signal from the turn-on signal control circuit and a signal output from the comparator, and output a first driving signal to a driving circuit;

the driving circuit, configured to receive the first driving signal from the trigger circuit, wherein when the output from the comparator is the turn-off signal for the power switch, the driving circuit controls to turn off the power switch; when the output from the turn-on signal control circuit is the turn-on signal for the power switch, the driving circuit controls to turn on the power switch.

2. The controller of claim 1, and further comprising:

dimming phase detection circuit, configured to detect a triac dimming phase of the input AC voltage, and convert a dimming phase signal to a DC voltage signal and feed the DC voltage signal to an input terminal of the multiplier in which the DC voltage signal multiplies with the instantaneous input AC voltage, in order to realize dimming effect.

3. The controller of claim 2, wherein the input dimming phase detection circuit comprises:

a dimming comparator circuit, configured to compare an input triac dimming signal with a predetermined reference voltage which is near zero, and convert the input dimming signal to a duty cycle signal that varies with a dimming phase;

a low-pass filter, configured to filter the duty cycle signal to a DC voltage signal which is the dimming phase signal wherein the dimming phase signal is input to the input terminal of the multiplier circuit in which the DC voltage signal multiplies with the instantaneous input AC voltage.

4. The controller of claim 2, wherein further comprising:

a circuit for detecting effective input AC voltage or average input AC voltage, configured to detect and obtain the effective input AC voltage or the average input AC voltage, which is then fed into an input terminal of the multiplier circuit in which the instantaneous input AC voltage is divided by the effective input AC voltage or the average input AC voltage and an AC input detection signal irrelevant with the effective input AC voltage or the average input AC voltage is obtained, the AC input detection signal is a normalized instantaneous AC input which replaces the instantaneous input AC voltage.

5. The controller of claim 2, wherein the comparator circuit is replaced with a second timer circuit, and the conduct time of the power switch is controlled by the second timer circuit, wherein when the conduct time of the power switch reaches a fixed conduct time set by the second timer circuit, the second timer circuit outputs a turn-off signal for the power switch, when there is a need to output a constant current regardless of a high voltage or a low voltage, the fixed conduct time is in inverse proportion with the effective input AC voltage or the average input AC voltage.

6. The controller of claim 1, wherein the turn-on signal control circuit is implemented with a circuit for charging and discharging a capacitor with a current, wherein the current for charging and discharging the capacitor refers to the following: a charging current for charging the capacitor within the conduct time of the freewheeling diode at the secondary side; a discharging current for discharging the capacitor within a non-conduct time of the freewheeling diode at the secondary side, wherein by balancing the charging charges and the discharging charges, the ratio of the conduct time of the freewheeling diode at the secondary side to the switching cycle is controlled so that the ratio is in direct proportion to the reference voltage output by the multiplier circuit.

7. The controller of claim 1, wherein the turn-on signal control circuit is a first timer circuit configured to control the ratio of the conduct time of the freewheeling diode at the secondary side to the switching cycle so that the ratio is in direct proportion to a first reference voltage signal output by the multiplier circuit.

8. The controller of claim 1 and further comprising:

a circuit for detecting effective input AC voltage or average input AC voltage, configured to detect and obtain the effective input AC voltage or the average input AC voltage, which is then fed into an input terminal of the multiplier circuit in which the instantaneous input AC voltage is divided by the effective input AC voltage or the average input AC voltage and an AC input detection signal irrelevant with the effective input AC voltage or the average input AC voltage is obtained, the AC input detection signal is a normalized instantaneous AC input which replaces the instantaneous input AC voltage.

9. The controller of claim 8, wherein the circuit for detecting effective input AC voltage or average input AC voltage is implemented with a low-pass filter.

10. The controller of claim 1, wherein the comparator circuit is replaced with a second timer circuit, and the conduct time of the power switch is controlled by the second timer circuit, wherein when the conduct time of the power switch reaches a fixed conduct time set by the second timer circuit, the second timer circuit outputs a turn-off signal for the power switch, when there is a need to output a constant current regardless of a high voltage or a low voltage, the fixed conduct time is in inverse proportion with the effective input AC voltage or the average input AC voltage.

11. The controller of claim 10, wherein the fixed conduct time controlled by the second timer circuit is in inverse proportion with the dimming phase signal.

12. A method for controlling a primary-side controlled switch-mode power supply for driving LED with constant current, comprising the following steps:

step 1: sampling an instantaneous input AC voltage and then outputting to an input terminal of a multiplier;

step 2: outputting, by the multiplier, a reference voltage signal which is in direct proportion to the instantaneous input AC voltage;

step 3: turning off a power switch of the switch-mode power supply when a peak current at a primary side of a transformer reaches the reference voltage signal;

step 4: detecting a voltage across an auxiliary winding of the switch-mode power supply and obtaining a conduct time of a freewheeling diode at a secondary side;

step 5: setting a ratio of the conduct time of the freewheeling diode at the secondary side to a switching cycle of the power switch such that the ratio is in direct proportion to the reference voltage signal output by the multiplier, calculating the switching cycle of the power switch so as to control the moment when the power switch starts to turn on, and outputting the turn-on signal of the power switch.

13. The method of claim 12, wherein step 1 further comprises:

detecting an effective input AC voltage or average input AC voltage, obtaining the effective input AC voltage or the average input AC voltage, feeding into an input terminal of the multiplier; dividing, in the multiplier, the input AC voltage by the effective input AC voltage or the average input AC voltage, obtaining an AC input detection signal irrelevant with the effective input AC voltage or the average input AC voltage, wherein the AC input detection signal is a normalized instantaneous AC input which serves as the reference voltage signal.

14. The method of claim 12, wherein step 1 further comprises:

detecting a triac dimming phase of the instantaneous input AC voltage, and converting a dimming phase signal to a DC voltage signal to feed to an input terminal of the multiplier in which the DC voltage signal multiplies with the instantaneous input AC voltage, in order to realize dimming effect.

15. The method of claim 14 wherein step 1 further comprises:

multiplying the normalized instantaneous AC input voltage with the dimming phase signal and obtaining the reference voltage signal when both a triac dimming function and a constant current regardless of a high voltage or a low voltage are desired.

16. The method of claim 14, wherein the step 3 is replaced by the following: the power switch conduct time of the switch-mode power supply is generated by a circuit for generating a fixed turn-on time, wherein the switch conduct time is fixed all the time.

17. The method of claim 12, wherein the step 3 is replaced by the following: the power switch conduct time of the switch-mode power supply is generated by a circuit for generating a fixed turn-on time, when there is a need to output a constant current regardless of a high voltage or a low voltage, the fixed conduct time is in inverse proportion with the effective input AC voltage or the average input AC voltage; and when there is need to realize the triac dimming function, the fixed conduct time is in direct proportion with the dimming phase signal.

18. A primary-side controlled switch-mode power supply apparatus for driving LED, comprising an AC input rectification circuit (101), an output rectification circuit (D1), a switch-mode power supply controller (201) for inputting a sampled input AC voltage Vac, a sampling resistor Rs for sampling a primary current of an isolation transformer (105), a power switch (106), the isolation transformer (105) for transferring an input energy to an output wherein the switch-mode power supply controller (201) comprises:

a multiplier circuit, configured to receive a signal indicative of an instantaneous input AC voltage, and output a reference voltage signal, wherein the reference voltage signal is in direct proportion with the instantaneous input AC voltage;

a zero-crossing detection circuit, configured to receive an auxiliary winding signal, detect a conduct time of a freewheeling diode at a secondary side, and output a zero-crossing detection signal;

a turn-on signal control circuit, configured to receive the zero-crossing detection signal output by the zero-crossing detection circuit and the reference voltage signal output by the multiplier circuit, control a ratio of the conduct time of the freewheeling diode at the secondary side to a switching cycle of a power switch such that the ratio is in direct proportion to the reference voltage signal output by the multiplier circuit, calculate the switching cycle of the power switch so as to control the moment when the power switch starts to turn on, and output a turn-on signal of the power switch;

a comparator circuit, configured to sample a peak current at the primary side of a isolation transformer of the switch-mode power supply and compare the peak current with the reference voltage signal, wherein when a voltage sampled from the peak current at the primary side equals the reference voltage signal output by the multiplier circuit, the comparator circuit is configured to output a turn-off signal for the power switch;

a trigger circuit, configured to receive an output control signal from the turn-on signal control circuit and a signal output from the comparator, and output a first driving signal to a driving circuit;

the driving circuit, configured to receive the first driving signal from the trigger circuit, wherein when the output from the comparator is the turn-off signal for the power switch, the driving circuit controls to turn off the power switch such that when the peak current at the primary side reaches a predetermined comparison point, the power switch turns off; when the output from the turn-on signal control circuit is the turn-on signal for the power switch, the driving circuit controls to turn on the power switch.

19. The apparatus of claim 18, wherein the switch-mode power supply controller (201) further comprises:

dimming phase detection circuit, configured to detect a triac dimming phase of the input AC voltage, and convert triac a dimming phase signal to a DC voltage signal and feed the DC voltage signal to an input terminal of the multiplier in which the DC voltage signal multiplies with the instantaneous input AC voltage, in order to realize dimming effect.

20. The apparatus of claim 19, wherein the input dimming phase detection circuit of the switch-mode power supply controller (201) further comprises:

a dimming comparator circuit, configured to compare an input triac dimming signal with a predetermined reference voltage which is near zero, and convert the input triac dimming signal to a duty cycle signal that varies with a dimming phase;

a low-pass filter, configured to filter the duty cycle signal to a DC voltage signal which is the dimming phase signal wherein the dimming phase signal is fed to the input terminal of the multiplier in which the DC voltage signal multiplies with the instantaneous input AC voltage.

21. The apparatus of claim 19, wherein the switch-mode power supply controller (201) further comprises:

a circuit for detecting effective input AC voltage or average input AC voltage, configured to detect and obtain the effective input AC voltage or the average input voltage, which is then fed into an input terminal of the multiplier in which the instantaneous input AC voltage is divided by the effective input AC voltage or the average input AC voltage and an AC input detection signal irrelevant with the effective input AC voltage or the average input AC voltage is obtained, the AC input detection signal is a normalized instantaneous AC input which replaces the instantaneous input AC voltage.

22. The apparatus of claim 19, wherein the comparator circuit of the switch-mode power supply controller (201) is replaced with a second timer circuit, and the conduct time of the power switch is controlled by the second timer circuit, wherein when the conduct time of the power switch reaches a fixed conduct time set by the second timer circuit, the second timer circuit outputs a turn-off signal for the power switch, when there is a need to output a constant current regardless of a high voltage or a low voltage, the fixed conduct time is in inverse proportion with the effective input AC voltage or the average input AC voltage.

23. The apparatus of claim 18, wherein the turn-on signal control circuit of the switch-mode power supply controller (201) is implemented with a circuit for charging and discharging a capacitor with a current, wherein the current for charging and discharging the capacitor refers to the following: a charging current for charging the capacitor within the conduct time of the freewheeling diode at the secondary side; a discharging current for discharging the capacitor within a non-conduct time of the freewheeling diode at the secondary side, wherein by balancing the charging charges and the discharging charges, the ratio of the conduct time of the freewheeling diode at the secondary side to the switching cycle is controlled so that the ratio is in direct proportion to the reference voltage output by the multiplier circuit.

24. The apparatus of claim 18, wherein the turn-on signal control circuit of the switch-mode power supply controller (201) is a timer circuit configured to control the ratio of the conduct time of the freewheeling diode at the secondary side to the switching cycle such that the ratio is in direct proportion to the reference voltage signal output by the multiplier.

25. The apparatus of claim 18, wherein the switch-mode power supply controller (201) further comprises:

a circuit for detecting effective input AC voltage or average input AC voltage, configured to detect and obtain the effective input AC voltage or the average input AC voltage, which is then fed into an input terminal of the multiplier in which the instantaneous input AC voltage is divided by the effective input AC voltage or the average input AC voltage and an AC input detection signal irrelevant with the effective input AC voltage or the average input AC voltage is obtained, the AC input detection signal is a normalized instantaneous AC input which replaces the first instantaneous input AC voltage.

26. The apparatus of claim 25, wherein the circuit for detecting effective input AC voltage or average input AC voltage which is implemented with a low-pass filter.

27. The apparatus of claim 18, wherein the comparator circuit of the switch-mode power supply controller (201) is replaced with a second timer circuit, and the conduct time of the power switch is controlled by the second timer circuit, wherein when the conduct time of the power switch reaches a fixed conduct time set by the second timer circuit, the second timer circuit outputs a turn-off signal for the power switch, when there is a need to output a constant current regardless of a high voltage or a low voltage, the fixed conduct time is in inverse proportion with the effective input AC voltage or the average input AC voltage.

28. The apparatus of claim 27, wherein the fixed conduct time controlled by the second timer circuit is in direct proportion with the dimming phase signal.

* * * * *